United States Patent [19]

Hammer et al.

[11] 3,990,164

[45] Nov. 9, 1976

[54] HOUSEHOLD FLATPLATE IRONER

[75] Inventors: Urs Hammer, Oberbuchsiten; Joseph von Rohr, Kestenholz, both of Switzerland

[73] Assignee: Jura-Elektroapparate-Fabriken L. Henzirohs A.G., Solothurn, Switzerland

[22] Filed: Mar. 15, 1976

[21] Appl. No.: 666,753

[30] Foreign Application Priority Data

Mar. 17, 1975 Switzerland ..... 3385/75

[52] U.S. Cl. ..... 38/71; 38/17; 38/1 D

[51] Int. Cl.[2] ..... A47J 51/00

[58] Field of Search ..... 38/1 R, 1 D, 17, 19, 38/25, 39, 40, 41, 71, 72, 27, 69, 70

[56] References Cited

UNITED STATES PATENTS

| | | | |
|---|---|---|---|
| 2,306,473 | 12/1942 | Strobridge | 38/25 |
| 2,424,623 | 7/1949 | Monsarrat | 38/1 D |
| 3,439,437 | 4/1969 | McFarland et al. | 38/71 |
| 3,757,440 | 9/1973 | Fresard et al. | 38/17 |

*Primary Examiner*—G. V. Larkin
*Attorney, Agent, or Firm*—Zarley, McKee, Thomte, Voorhees & Sease

[57] ABSTRACT

A household flatplate ironer comprising two cooperating pressing plates, the upper one of which is lowerable onto the lower one by means of a supporting arm and a counterpoise, is provided with means for reopening the ironer automatically after it has remained closed for a predetermined period of time, thus affording an article of laundry being ironed to cool off without suffering damage from overheating.

3 Claims, 5 Drawing Figures

HOUSEHOLD FLATPLATE IRONER

This invention relates to a household flatplate ironer comprising a stationary frame, a lower pressing plate secured to the frame, a supporting arm pivotable at one end with respect to the frame, an upper pressing plate secured to the other end of the arm and adapted to cooperate with the lower pressing plate, a counterpoise pivotable past dead-center for holding the arm either in a raised position or in a lowered position in which the upper pressing plate rests upon the lower pressing plate, spring means for biasing the counterpoise, and a pull rod connected to the counterpoise for producing ironing pressure between the pressing plates.

It has already been proposed to equip household flatplate ironers of this kind with electrical safety devices designed to cut off the heating current whenever the ironer is not re-opened after a certain period of time has elapsed since the supporting arm was last lowered, i.e., whenever the supporting arm has not been moved from its lowered position to its raised position. Although such safety devices have the advantage of preventing any further heating of the upper pressing plate, they cannot eliminate the risk of damage to an article of laundry lying between the plates, for the heat capacity of the upper plate is so great that the article continues to be heated despite the cut-off of the current, and this leads to discoloration or even burning of the article.

It is an object of this invention to provide a household flatplate ironer of the kind described above in which the aforementioned shortcoming is eliminated by automatically initiating cooling of the article being ironed after a predetermined period of time has elapsed since the supporting arm with the upper pressing plate was last lowered.

To this end, the household flatplate ironer according to the present invention further comprises opening means operatively connected to the counterpoise for moving the arm from the lowered position into the raised position, and means for automatically actuating the opening means whenever a predetermined period of time has elapsed since the last movement of the arm into the lowered position.

A preferred embodiment of the invention will now be described in detail with reference to the accompanying drawings, in which.

Figure 1:
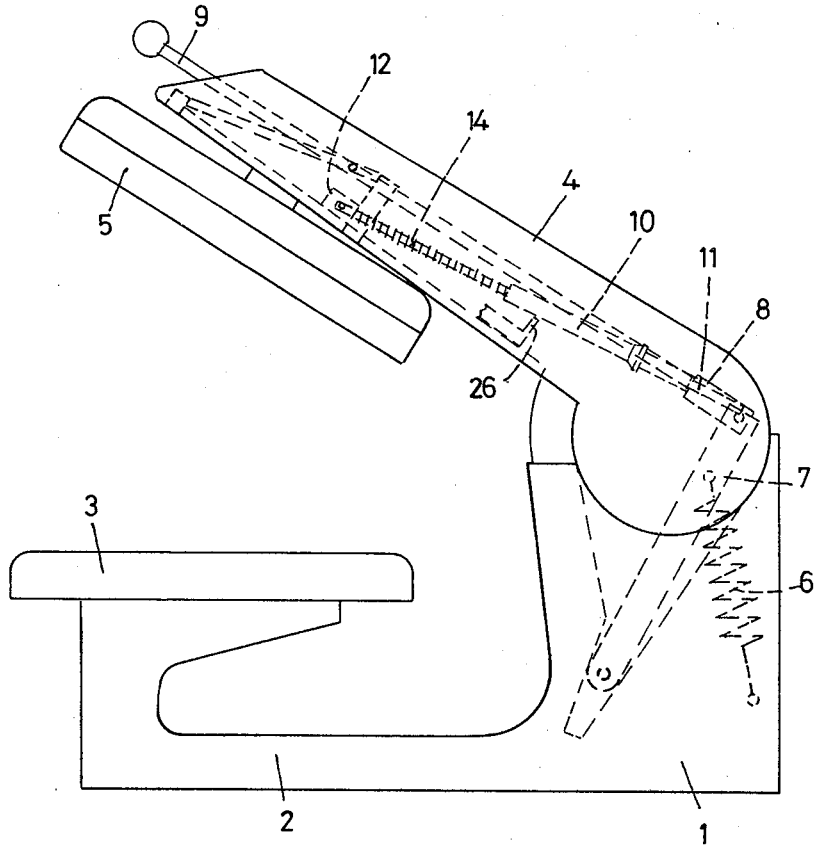
FIG. 1 is a diagram of the ironer in opened position.
Figure 2:
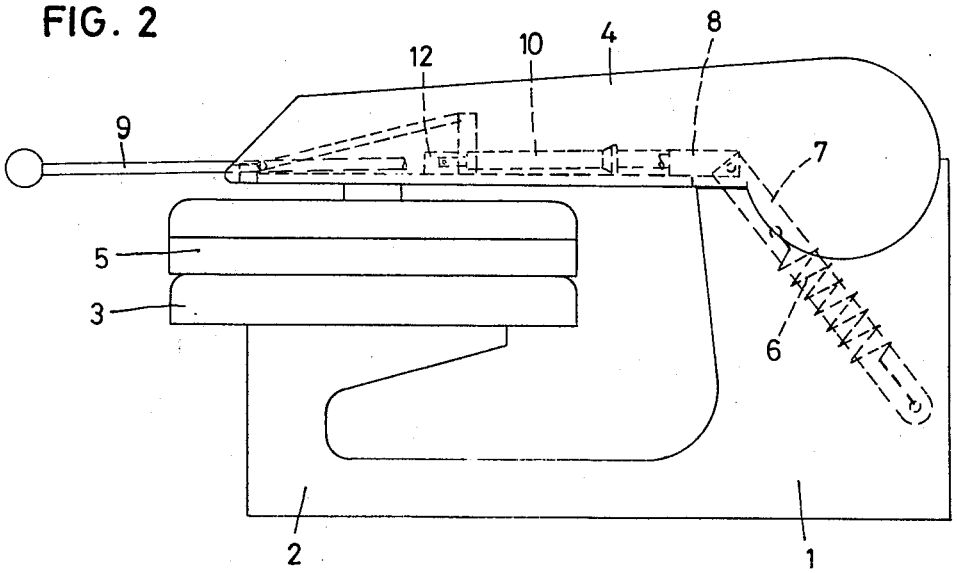
FIG. 2 is a diagram of the ironer in closed position.
Figure 3:
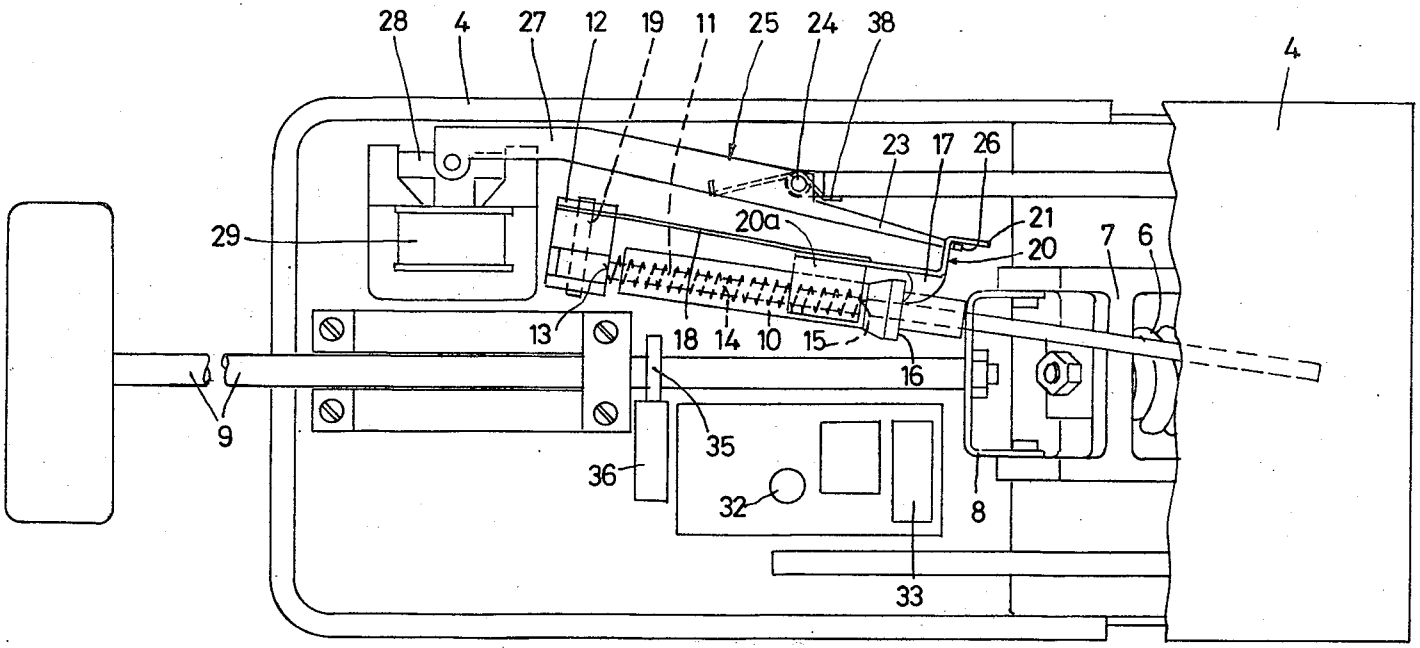
FIG. 3 is a top plan view of the opening means on a larger scale.
Figure 4:
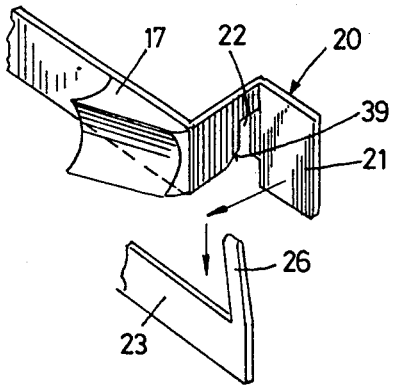
FIG. 4 is a perspective view of a structural detail.

As in customary, the household flatplate ironer illustrated in the drawings comprises a frame 1 having a forwardly extending foot 2, to the free end of which a stationary lower pressing plate 3 is secured. Pivotingly mounted on the frame 1 is a supporting arm 4 bearing a heated upper pressing plate 5 intended to be lowered onto the plate 3 for the purpose of ironing. The pivoting mechanism comprises a tension spring 6 acting upon a counterpoise 7 which, when the arm 4 is pivoted, is swivelled past its dead-center position so that the spring 6 holds the arm 4 in both the opened position (FIG. 1) and the closed position (FIG. 2). The actual ironing pressure is then produced by additional stretching of the spring 6. Hinged to the top of the counterpoise 7 for this purpose is a bracket 8 to which a pull rod 9 is rigidly secured so that by pulling the rod 9 forward, the spring 6 can be subjected to additional tension (cf. FIG. 2). Also integral with the bracket 8 is a spring cage 10 through which a guide rod 11 passes, which is in turn slidable in a corresponding opening in the bracket 8. At its forward end, the guide rod 11 is pivotingly mounted in a bearing block 12 and has at its bearing site a stop surface 13 against which the forward end of an opening spring 14 rests, through which spring the guide rod 11 passes. The rearward end of the opening spring 14, which takes the form of a compression spring, presses against the back of the spring cage 10, so that the spring 14 tends to push the spring cage 10, and thus the bracket 8 together with the counterpoise 7, towards the rear. On the outside of the rearward end of the spring cage 10 is a conical stop piece 16 which cooperates with a latch 17 affixed to the end of a resilient arm 18 secured to the bearing block 12. Hence, under certain circumstances, to be described below, the resilient arm 18 is capable of swivelling out laterally, thus moving the latch 17 away from the stop piece 16 and freeing the spring cage 10, which then moves towards the rear under the effect of the opening spring 14. Just in front of the latch 17, the resilient arm 18 has a U-shaped guide piece 20*a* which embraces the spring cage 10 from above and below, so that the swivelling movement of the spring cage 10 about its spindle 19, held in the bearing block 12—to which swivelling movement the spring cage 10 is subjected upon a movement of the counterpoise 7—is transmitted to the resilient arm 18 and thus to the latch 17, and vice versa. At the outer end of the latch 17 is a laterally projecting, angular extension 20, having a slot 22 on its underside and comprising a catch plate 21. Into the slot 22 there enters one arm 23 of an opening lever 25, in the form of a two-armed lever pivotable about a spindle 24, the free end of which arm 23 is bent upwards to form a catch 26. Consequently, when the catch 26 is swivelled outwards in a manner to be described below, it strikes against the catch plate 21 and swivels the extension 20, and hence the resilient arm 18 together with the latch 17, outwards, whereby the latch 17 leaves the stop piece 16 and frees the spring cage 10 to be acted upon by the opening spring 14. Hinged to the other arm 27 of the opening lever 25 is the armature 28 of an opening magnet 28/29, the actuating of which pivots the lever 25 counterclockwise, as viewed in FIG. 3, and initiates the movement which releases the spring cage 10 as described above.

Included in the electric circuit of the field coil 29 cooperating with the armature 28 is a switch 30 which is controlled by a delayed drop-out relay 31. The relay 31 in turn forms part of a timer circuit which, in the present case, comprises a switching diode 32 and a capacitor 33. This circuit is powered from the mains via a rectifier 34, and the capacitor 33 is charged until the break-down voltage of the switching diode 32 is reached. When the diode 32 breaks down, the capacitor 33 discharges, so that the relay 31 responds and actuates the switch 30 and thus the armature 28. The timer could be replaced by some other type of circuit, or possibly by mechanical means, by which, after a certain period of time has elapsed, a current surge is produced which causes the magnet 28/29 to respond.

Figure 5:
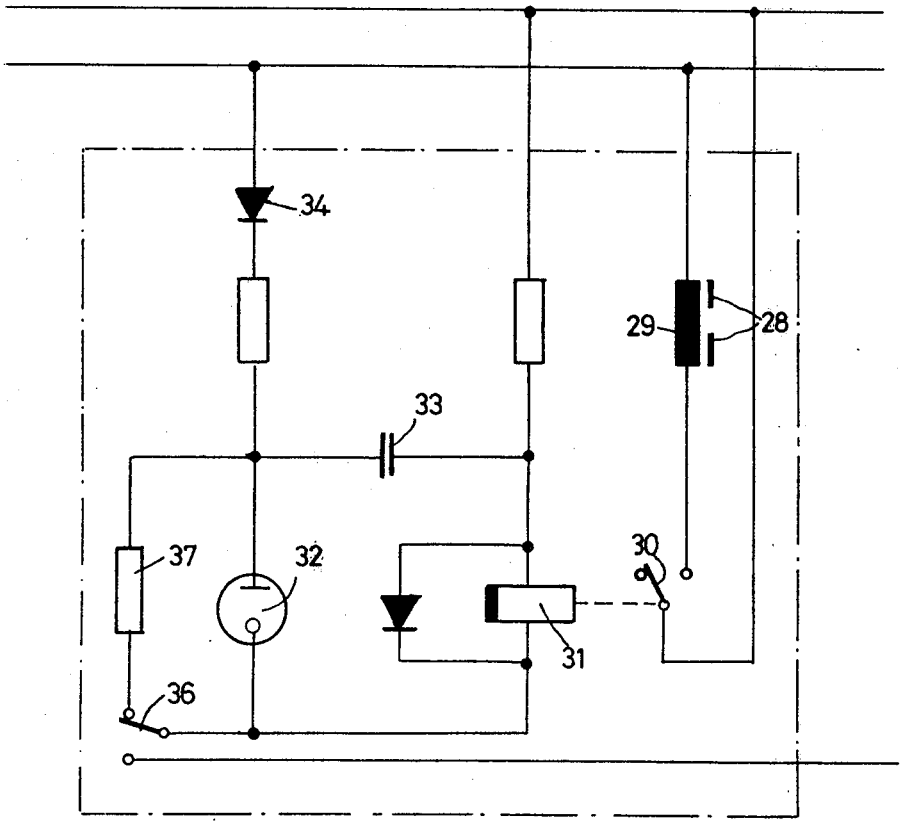
FIG. 5 is a circuit diagram.

When the ironer is completely closed, i.e., when the pull rod 9 is pulled forward, this rod swivels downward for a certain distance. This swivelling movement is used to operate a normally raised finger 35, which throws a switch 36, thereby cutting out a resistor 37, connected in parallel to the diode 32, so that the circuit is closed and the timer becomes operative. If the critical period of time to which the timing unit is set does not elapse, i.e., if the voltage of the capacitor 33 does not reach the break-down voltage of the diode 32, before the supporting arm 4 is raised again, the capacitor 33 discharges upon opening of the ironer, when the switch 36 is thereby thrown into the position shown in FIG. 5 via the resistor 37, without the relay 31 having responded. Otherwise, the capacitor 33 discharges as described, via the switching diode 32, so that the magnet 28/29 is actuated via the relay 31. As a result, the two-armed opening lever 25 is pivoted by the armature 28 in such a way that its arm 23 is moved counterclockwise, as viewed in FIG. 3. The catch 26 therefore pushes the catch plate 21 outwardly, and the latch 17 leaves the stop piece 16, so that the opening spring 14, via the spring cage 10, moves the bracket 8 and hence the counterpoise 7 towards the rear, thus causing the ironer to open, i.e., causing the supporting arm 4 together with the upper pressing plate 5 to swing up.

The article of laundry being ironed now lies exposed and can cool off without any danger of its being damaged. The pivoting of the counterpoise 7 naturally also entails a pivoting of the guide rod 11 together with the spring cage 10, the spring 14, and the resilient arm 18, which thus moves out of reach of the catch 26 of the lever arm 23. The opening lever 25 is pivoted back into its original position by the action of a retractile spring 38. The next time the ironer is used, i.e., when the supporting arm 4 is again lowered and the rod 9 pulled forward, the unit formed by the guide rod 11, the spring cage 10, and the resilient arm 18 moves downwards, and an inclined surface 39, limiting the slot 22 in the extension 20 towards the inside, then strikes against the top of the rear arm 23 of the opening lever 25, whereby, as the lowering movement is continued, the resilient arm 18 and the latch 17 are swivelled clockwise, as viewed in FIG. 3, so that the latch 17 can once more engage against the stop piece 16, and all parts of the ironer have regained their starting positions.

This arrangement thus provides an opening means (guide rod 11, spring cage 10, opening spring 14, latch 17 with resilient arm 18, opening lever 25, and magnet 28/29) which makes it possible to swing the supporting arm 4 with the upper pressing plate 5 up into the open position as soon as an adjustable period of time, during which the ironer remains closed, is exceeded.

What is claimed is:

1. A household flatplate ironer comprising a stationary frame, a lower pressing plate secured to said frame, a supporting arm pivotable at one end with respect to said frame, an upper pressing plate secured to the other end of said arm and adapted to cooperate with said lower pressing plate, a counterpoise pivotable past dead-center for holding said arm either in a raised position or in a lowered position in which said upper pressing plate rests upon said lower pressing plate, spring means for biasing said counterpoise, and a pull rod connected to said counterpoise for producing ironing pressure between said pressing plates, said ironer further comprising opening means operatively connected to said counterpoise for moving said arm from said lowered position into said raised position, and means for automatically actuating said opening means whenever a predetermined period of time has elapsed since the last movement of said arm into said lowered position.

2. An ironer in accordance with claim 1, wherein said opening means comprise a spring adapted to act upon said counterpoise, a latch device for releasing said spring, and timing means for controlling the operation of said latch device.

3. An ironer in accordance with claim 2, wherein said opening means further comprise a spring cage operatively connected to said counterpoise and a stop piece disposed on said spring cage, said spring being accommodated in said spring cage, and said stop piece cooperating with said latch device.

* * * * *